US006947022B2

(12) United States Patent
McCartney

(10) Patent No.: US 6,947,022 B2
(45) Date of Patent: Sep. 20, 2005

(54) DISPLAY LINE DRIVERS AND METHOD FOR SIGNAL PROPAGATION DELAY COMPENSATION

(75) Inventor: Richard I. McCartney, Scotts Valley, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 40 days.

(21) Appl. No.: 10/074,119

(22) Filed: Feb. 11, 2002

(65) Prior Publication Data

US 2003/0160753 A1 Aug. 28, 2003

(51) Int. Cl.[7] ..... G09G 3/36

(52) U.S. Cl. ..... 345/99; 345/100; 345/205; 345/208; 345/87

(58) Field of Search ..... 345/98, 99, 100, 345/208

(56) References Cited

U.S. PATENT DOCUMENTS 5,854,615 A * 12/1998 Hush ..... 345/99

6,628,273 B1 * 9/2003 Rindal et al. ..... 345/208

* cited by examiner

*Primary Examiner*—Dennis-Doon Chow
*Assistant Examiner*—Ming-Hun Liu
(74) *Attorney, Agent, or Firm*—Cahill, von Hellens & Glazer, PLC

(57) ABSTRACT

Methods and apparatus for compensating the effects of display signal propagation delay in a display panel are disclosed. The apparatus comprises circuitry in addition to conventional display driver circuitry for delaying display line timing signals by an amount approximating the delay found in corresponding display lines. By delaying display line timing signals, for example in a column driver, by an time approximately equal the delay experienced in a corresponding row enable signal line, capacitors associated with the display pixels charge more fully resulting in a more vivid display image. Methods for compensating the effects of display signal propagation delay involve generating a plurality of delayed display timing signals and activating display lines in response to those delayed timing signals.

40 Claims, 12 Drawing Sheets

DISPLAY LINE DRIVERS AND METHOD FOR SIGNAL PROPAGATION DELAY COMPENSATION

BACKGROUND OF THE INVENTION

1. Field of the Invention

The present invention relates generally to row and column drivers of a display panel. More particularly, the present invention relates to a method and apparatus for compensating propagation delay in display drivers through delaying a column driver enable signal by a time approximating the delay experienced by signals propagating in a corresponding row signal line. The present invention also relates to a method and apparatus for compensating propagation delay in display drivers through delaying a row driver enable signal by a time approximating the delay experienced by signals propagating in a corresponding column signal line.

2. Description of the Relevant Art

Many display panels, such as those used as televisions, computer monitors, and other video and stationary image displays, include a lattice of display signal lines formed in a plurality of rows and columns. Each junction of the lattice includes a switching device, typically a thin film transistor (TFT), a storage device, such as a capacitor, and an associated display element or pixel. To activate the switching devices to store the voltages necessary for appropriate pixels to display an image, column and row drivers are used in conjunction with one or more display controllers. The display controllers generate timing signals, such as column and row driver enable signals, for the respective column and row drivers which, in turn, generate appropriate voltage signals for specific pixel addresses. The use of pixels arranged in a lattice, as opposed to a cathode ray tube, enables relatively large display areas with relatively small display panel thickness.

The construction of a liquid crystal display (LCD) panel, for example, includes a plurality of addressed pixels formed in a lattice of pixel rows and columns. Each pixel in the lattice is addressed by a row selection signal line and a column driver signal line; a desired driving voltage is applied to such pixel, via the column driver signal line, when its row is selected via the row selection signal line. The aforementioned row selection signal line and column driver signal line are each coupled to control circuitry that determines what voltage will be applied to each pixel in a common row when that row is selected. In a color display panel, each position in the lattice preferably includes three subpixels for respectively emitting the primary colors red, green, and blue to provide a full color display panel. During pixel addressing periods, individual row signal lines are selectively enabled to select one row of pixels at a time, and column signal lines of the LCD panel are selectively driven with voltages unique to the current image content of the LCD panel. Selective address voltages are generated by driver controllers that are specifically designed for direct coupling to the LCD panel row and column signal lines.

To refresh a display panel, a row enable signal is transmitted to a first row of display pixels. This row enable signal activates the transistors associated with each of the pixels on that row and enables the transistors to transfer voltages on the column signal lines to the capacitors associated with the relevant pixels in that row. Substantially simultaneous with the row enable signal activation, a select plurality of the column signal lines is activated and voltages are transferred to the appropriate capacitors. For color displays, each pixel is associated with three column signal lines (red, green and blue). The column signal line through which the voltage is transferred and the magnitude of that voltage determines what color an associated pixel will be, and with what intensity the color will display. After a predetermined time for transfer, the row enable signal is switched low, storing the transferred voltage value in the capacitor. After a delay, the process is then repeated for the next sequential row on the display panel until all rows have been refreshed.

Early display panels were manufactured to have a screen size on the order of 10" (diagonal measurement) with a pixel density of 640×480 pixels, and delay problems resulting from a signal traveling from circuitry at one end of the display to the circuitry at another end of the display were considered by many to be negligible. Over time, however, display panels have become larger and pixel density has increased. These changes in display panels have compounded the once minor delay problems to a point that they should no longer be considered negligible.

As an illustration of the significance of potential delay involved in a refresh cycle, a conventional QXGA display having 2,048 vertical columns and 1,536 horizontal rows of pixels will be discussed. For each vertical column of pixels in a color display, there are actually three vertical columns of storage devices for storing values, one each for red, green and blue. Therefore, in a color QXGA display, there are 6,146 columns and 1,536 rows of signal lines. Displays are conventionally completely refreshed at a rate of at least 60 times per second, or at 60 Hz, to avoid flicker. Other displays, for example QSXGA+ displays, have even higher densities of pixels. With a QXGA color display having 1,536 rows of signal lines, the maximum time available to refresh each row ($t_{Rmax}$) is:

$$t_{R\max} = \frac{\left(\frac{1}{60\ \mathrm{s}}\right)}{1536\ \mathrm{rows}} = 10.85\ \mu\mathrm{s/row}$$

For each additional row of pixels added to the display, the available time to refresh those pixels decreases. Furthermore, at points where display row and column signal lines cross, parasitic capacitance is observed between the conductive signal lines. This parasitic capacitance may further slow signal propagation. Conventionally, there is approximately a 1 to 2.5 microseconds delay in the row enable signal by the end of a signal line in a QXGA display. In other words, if the row enable signal applied at one end of the row enable line switches from low to high at time zero, then the low to high transition will not appear at the opposite end of the row enable line in anywhere from 1 to 2.5 microseconds later. Increasingly greater effort must be spent in the design of larger format display panels in order to maintain such propagation delays within reasonably small values. Practical factors currently limiting the state of the art dictate that such propagation delay be approximately 1 to 2.5 microseconds. Despite there only being approximately one-quarter the number of pixels in an XGA display as in a QXGA display, the row enable signal propagation delay of an XGA display is approximately the same as that observed in a QXGA display. As discussed in greater detail hereinafter, display signal propagation delay may cause noticeable uneven display intensity or even display errors.

In attempts to resolve what has previously been considered only a minor problem, others have used wider, less resistive, signal lines to increase signal propagation and decrease delay. However, as the physical dimensions of the signal lines are increased, the physical space available for use as pixels necessarily decreases; this results in decreased pixel size, or aperture, and hence, less display surface area for active light modulation. In turn, less active light modulation area results in more light source power for the same display brightness effect. Increasing the thickness of the address conductors reduces the resistance at the expense of fabrication time. Reducing the overlap capacitance between the row and column line conductors through thicker dielectric separation also results in added fabrication expense. Other attempts at resolving the effects of display signal propagation delay include providing duplicate column drivers, one at the top of the display and one at the bottom of the display, and duplicate row drivers, one at the left of the display and one at the right of the display. Displays using these approaches, however, require additional circuitry and still may experience the varied pixel intensity problems caused by signal propagation delay.

SUMMARY OF THE INVENTION

It is an object of the present invention to compensate for row signal propagation delays in a display panel.

It is a further object of the present invention to compensate for column signal propagation delays in a display panel.

It is a still further object of the present invention to delay row enable signals to approximate the propagation delay of corresponding column signals.

It is another object of the present invention to delay column enable signals to approximate the propagation delay of corresponding row enable signals.

It is yet another object of the present invention to generate delayed column enable signals having start times approximating the times a row enable signal will reach each column.

It is an object of the invention to generate delayed row enable signals having start times approximating the times a column signal will reach each row.

The present invention provides a method and apparatus for reducing the effects of signal propagation delay in a conventional display panel, such as an LCD panel. According to a first aspect of the present invention, the timing of a column driver enable signal is adjusted to approximate the propagation delay of a signal in a corresponding row signal line. By enabling the column signal lines with the delayed column driver enable signal, the negative effects of signal propagation delay are significantly reduced. A column driver circuit includes circuitry to delay a column driver enable signal, or other column timing signal, by an amount which approximates the delay of a row enable signal as it propagates to the column activated by the column signal.

According to a second aspect of the present invention, the timing of a row driver enable signal is adjusted to approximate the propagation delay of a signal in a corresponding column signal line. By enabling the row signal lines with the delayed row driver enable signal, the negative effects of signal propagation delay are significantly reduced. A row driver circuit includes circuitry to delay a row enable signal, or other row timing signal, by an amount which approximates the delay of a column signal as it propagates to the row activated by the row enable signal.

Both digital and analog embodiments of display driver circuits are disclosed wherein a plurality of signal delay elements are operatively coupled together to delay a display timing signal propagating therethrough. The delay elements are chosen such that the delay experienced by a column or row timing signal approximates the delay experienced by a display signal propagating through a corresponding display line such as a row or column signal line.

Methods of compensating for display line signal propagation delay are also disclosed whereby a display line timing signal is generated. A first plurality of delayed display line timing signals is also generated and used to activate at least one row or column signal line. The first plurality of delayed display line timing signals is generated to approximate the delay of a signal propagating through an associated display line. A second plurality of delayed display line timing signals may also be generated in response to one or more of the first plurality of delayed display line timing signals to activate a display line of a display panel. In activating the display lines, the method may also track which display line is to be activated next, and select a delayed display line timing signal in accordance with an indication of the next display line to be activated. A method is also disclosed wherein a delayed display line timing signal is generated comprising components to activate a plurality of display lines at varying times from the timing signal components of the delayed display line timing signal. The components are each removed from the timing signal as they are used by a portion of the display driver circuit, and the remaining timing signal components are relayed to another portion of the display driver circuit.

BRIEF DESCRIPTION OF THE DRAWINGS

The nature of the present invention as well as specific embodiments of the present invention may be more clearly understood by reference to the following detailed description of the preferred embodiment of the invention, and to the drawings herein, wherein.

DETAILED DESCRIPTION OF THE INVENTION

Figure 1:
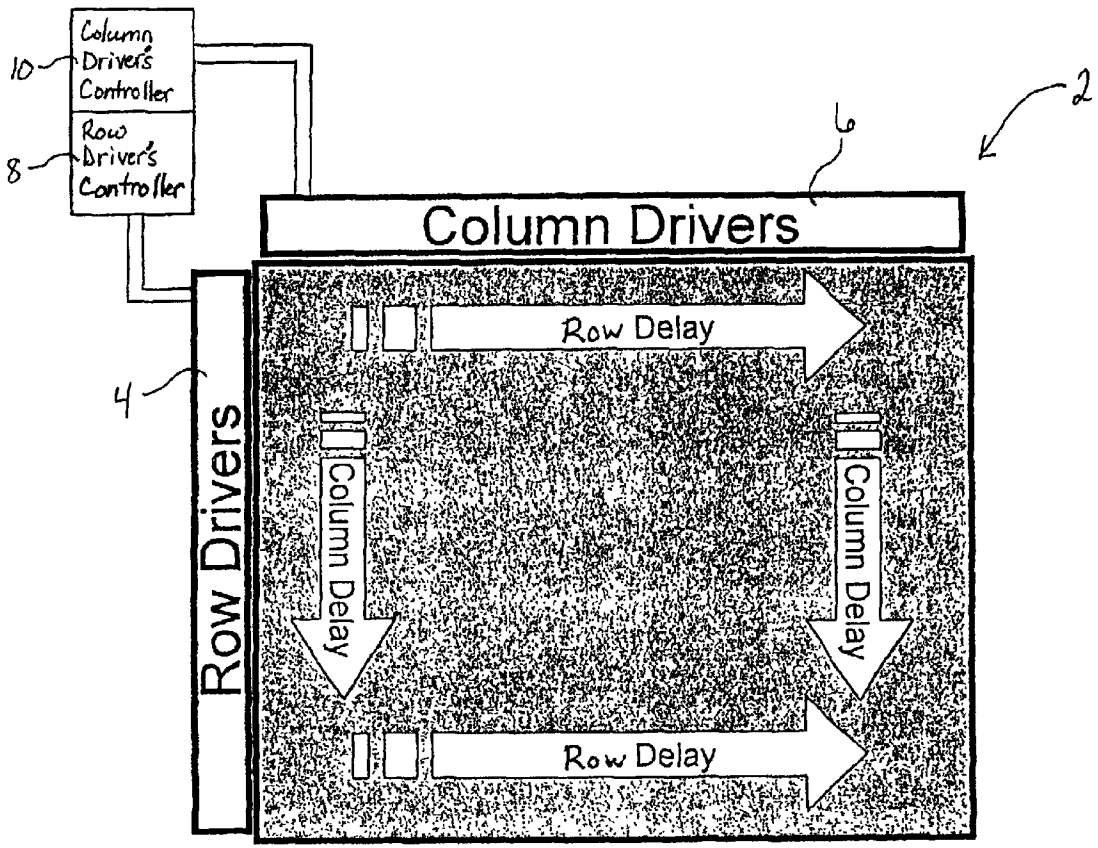
FIG. 1 is a block diagram of an LCD display panel configured according to a particular embodiment of the present invention.

To illustrate the specific nature of the signal propagation delay problem, reference is made to FIG. 1. FIG. 1 illustrates a portion of a display panel 2 having a plurality of row drivers 4 along the left side of the display and a plurality of column drivers 6 along the top of the display. Rows associated with the row drivers 4 are ordered sequentially from top to bottom and are conventionally refreshed in sequential order. The row drivers 4 and column drivers 6 are respectively controlled by row driver and column driver controllers 8 and 10 respectively. The row and column drivers 4 and 6 may be formed in common circuitry with the respective row and column driver controllers 8 and 10, or as separate circuitry. Row and column drivers 4 and 6 may be respectively placed along the right and bottom sides of the display in addition to or instead of the left and top sides, respectively.

Figure 2:
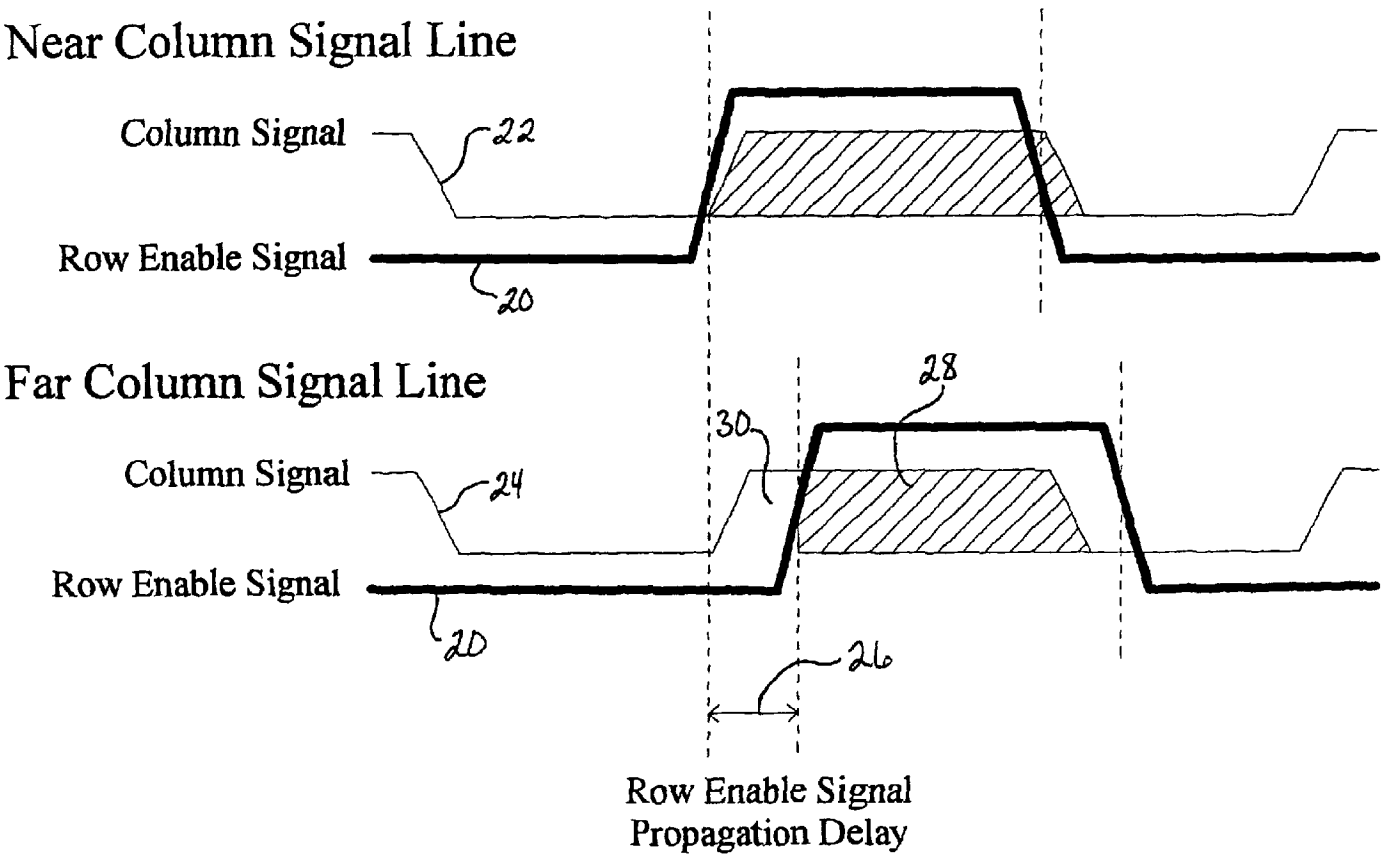
FIG. 2 is a timing diagram illustrating one effect of row enable signal propagation delay as between a column located near the row enable driver and a column located farther from the row driver.

When it is time to refresh the first row of pixels, a row enable signal is produced from the first row driver in the sequence of row drivers. In reference to FIG. 2, when a row enable signal 20 goes high, the TFT transistors coupled to such row are turned on and the storage capacitors associated with such TFT transistors begin to charge to the voltage present on their associated columns; in FIG. 2, column signals 22 and 24 represent two such columns located at opposite ends of the LCD display. Conventionally, the signals 22 and 24 on each of the column signal lines are activated at substantially the same time. As shown in the Near Column Signal Line example of FIG. 2, for column signal lines nearer the row driver (e.g., column signal 22), the row enable signal 20 has little or no propagation delay and, therefore, is high at the near column for all or nearly all of the time the column signal 22 is activated. As shown in the Far Column Signal Line example, however, due to row enable signal propagation delay 26, the row enable signal 20 may not reach columns farther from the row drivers until after the corresponding column signal 24 has been activated. A portion of the charge 28 available through the column signal 24 falls within the time when the row enable signal 20 is high at that far column signal line and is, therefore, stored on an appropriate capacitor. The remaining portion of the charge 30, which ideally would have been available to help charge the appropriate capacitor, is missed due to the signal propagation delay 26. Furthermore, when the column signal 24 transitions low before the row enable signal 20 transitions low, the capacitor associated with the corresponding row and column address discharges until the time row enable signal 20 transitions low, thus, further decreasing the charge on the capacitor from its appropriate charge value.

Because capacitors charge asymptotically and, therefore, never truly charge to their full value, the longer they charge, the closer to their full value they reach. Capacitors with fall values stored are closer to their intended intensity than those with less than their full voltage value stored. The net effect of uncompensated propagation delay is that the pixels farther from the row drivers may be proportionately less or more intense than those pixels nearer the row drivers, or that the colors emitted by pixels nearer the row drivers do not match the colors emitted by pixels farther from the row drivers.

Figure 3:
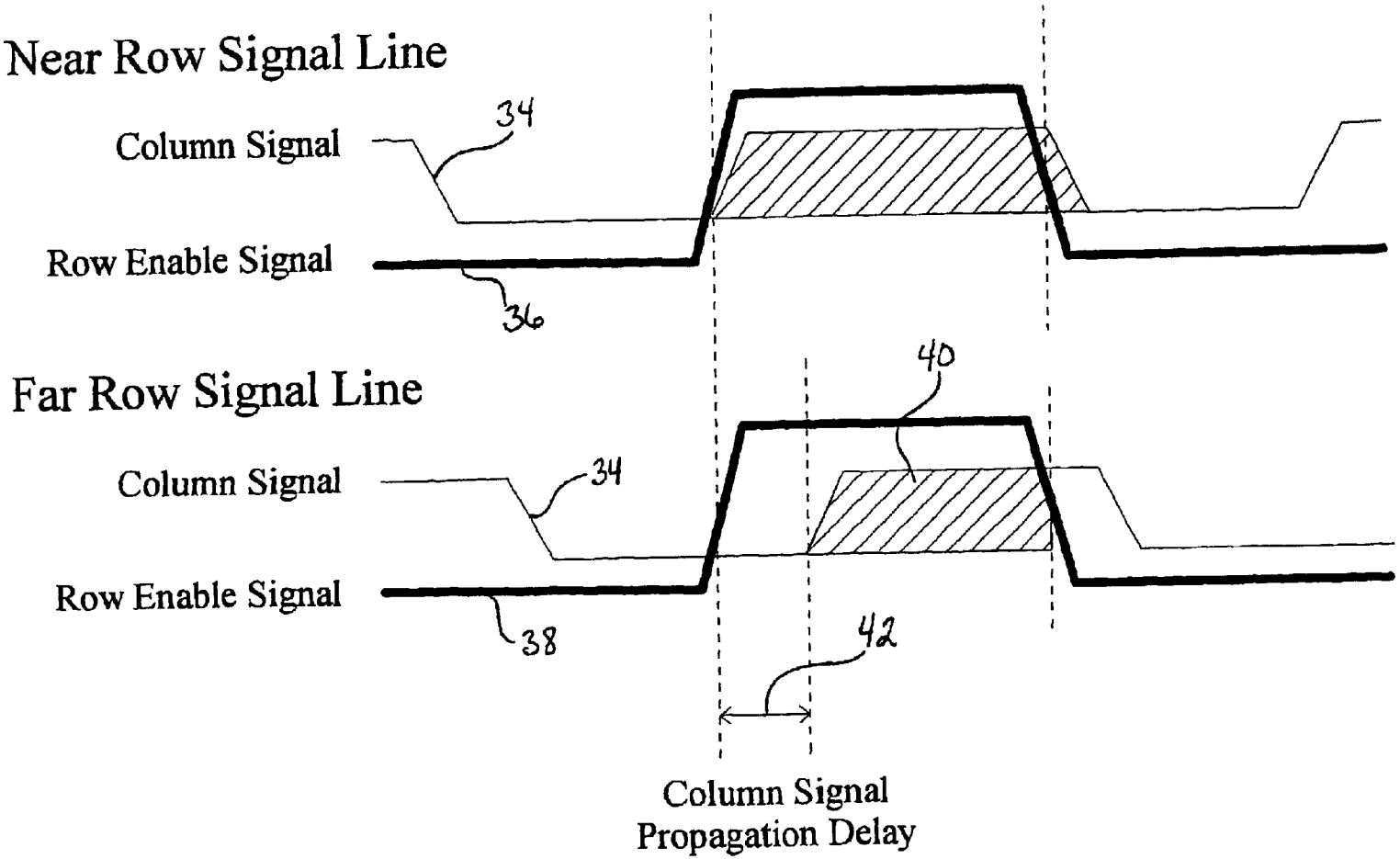
FIG. 3 is a timing diagram illustrating one effect of column signal propagation delay as between a row located near a column driver and a row located farther from the column driver.

The explanation of the effects of column signal propagation delays is similar to that of the row signal propagation delays. In reference to FIG. 3, every row is conventionally driven exactly the same length of time at a duration spaced evenly among the plurality of rows. The problem created by column signal propagation delay 42 is that it takes the column signal 34 longer to reach the pixel locations in the rows of the display farther from the column drivers than it takes for column signal 34 to reach those rows nearer the column drivers. As shown in the Near Row Signal Line example of FIG. 3, row enable signal 38 may go high a significant time before the column signal 34 reaches the farthest rows of the display, and row enable signal 38 may go low again before the column signal charge 40 has been fully stored on the appropriate capacitor.

The present invention significantly reduces the effects of signal propagation delays by addressing row signal line propagation delay and/or column signal line propagation delay. While these two aspects of the present invention will be addressed separately below, it will be understood by those skilled in the art that these aspect of the invention may be implemented independently of each other or, more preferably, in a common display.

Row Enable Signal Propagation Delay Compensation

In regard to row signal propagation delays, the solution described herein involves a column driver circuit which generates column enable signals which are not simultaneously produced, but which are intentionally delayed by a circuit which approximates the propagation delay experienced by a row enable signal. These delayed column enable signals are then used to activate column signal lines at a time where they will meet the propagation delayed row enable signals. In this way, each capacitor on a row is permitted to charge for approximately the same time regardless of its location along the row, and regardless of row enable signal propagation delays.

Figure 4:
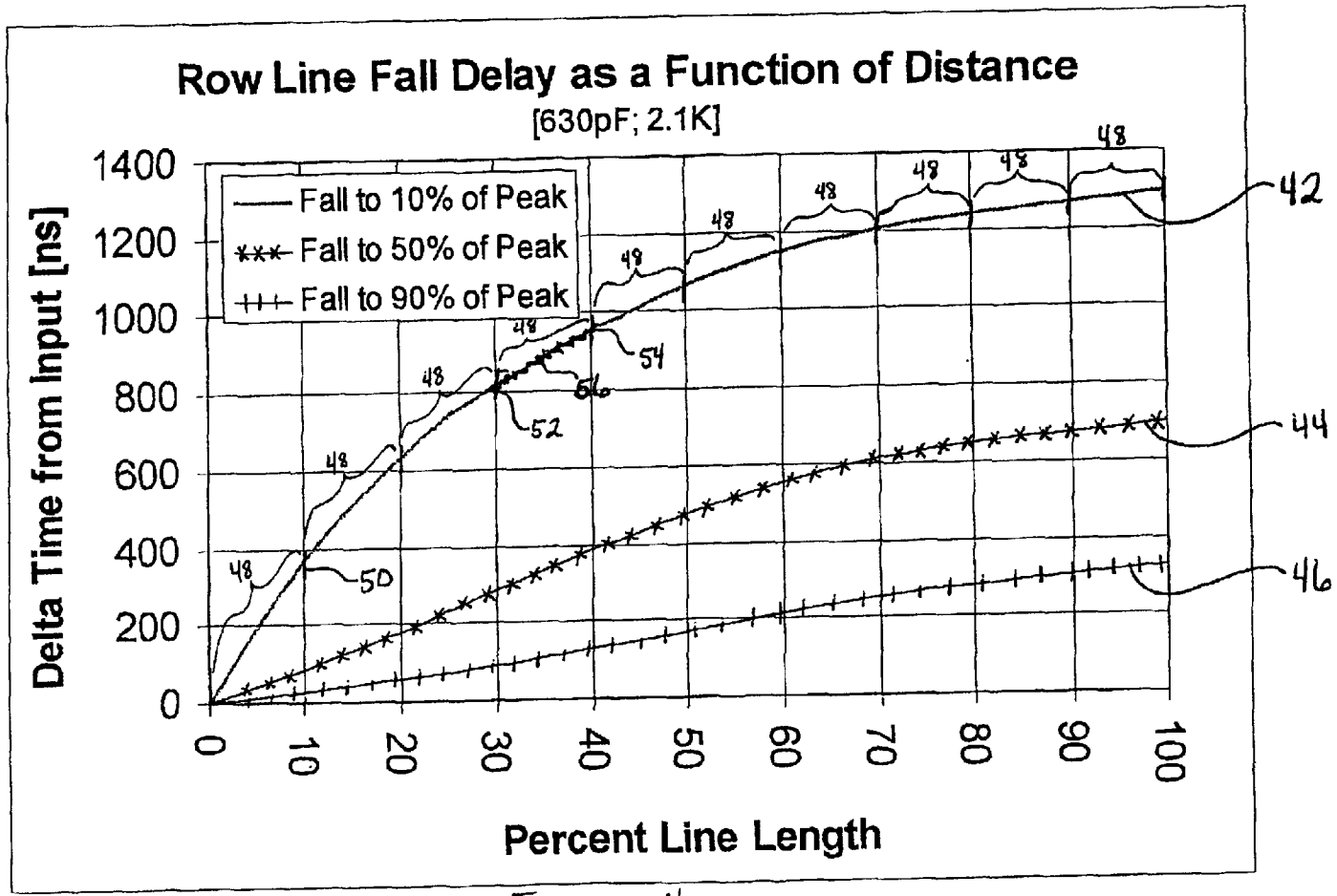
FIG. 4 is a graph illustrating several examples of delay/distance curves for row enable signal propagation delays.

The present invention fairly approximates row propagation delays by using a stepwise linear approximation of a delay curve for a row enable signal propagation delay as a function of the row line length. FIG. 4 includes a graph of three representative delay/distance curves 42, 44 and 46. A delay/distance curve may be charted by one of skill in the art by observing the actual propagation delay of a row enable signal in a display panel, or by simulating the circuitry of a display panel using one of the numerous electronics simulation software packages available on the market and plotting the timing signal of a row enable signal. An example of an appropriate electronics simulation software package is 'SPICE' distributed by Intusoft of San Pedro, Calif. The first curve 42 of FIG. 4 will be used for the examples herein. Each display panel's circuit design and implementation will vary and involve a different curve. Once an appropriate delay/distance curve is generated, as described hereinafter, the particular delay circuitry may be selected and implemented to delay the signals by analog or digital circuitry.

Figure 5:
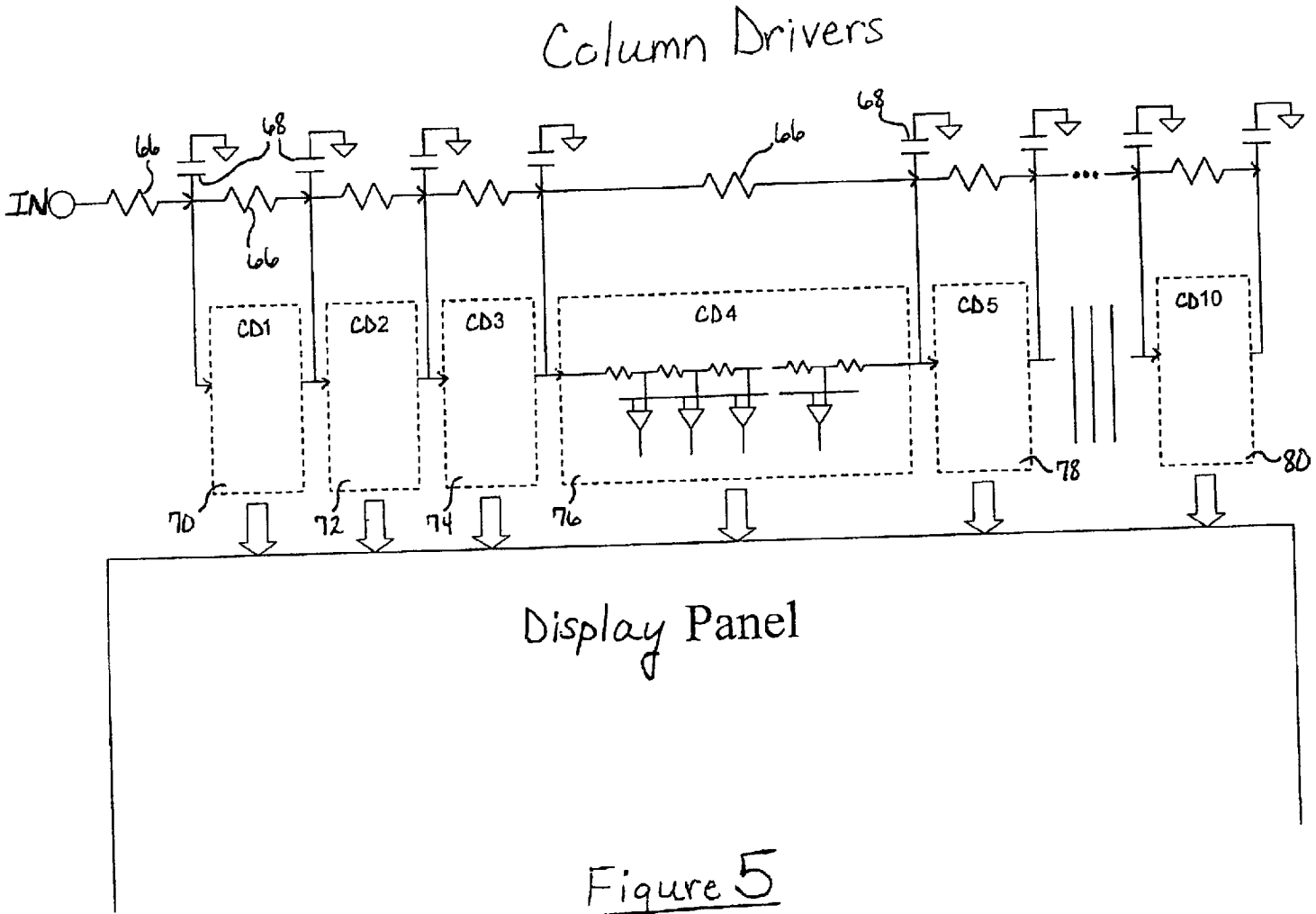
FIG. 5 is a diagram illustrating an analog implementation of a column driver enable signal delay circuit according to a particular embodiment of the present invention.

Analog Implementation: One embodiment of the invention implemented as an analog circuit for delaying the column driver signals is illustrated in FIG. 5. The lower portion 60 of FIG. 5 represents a display panel including a lattice of rows and columns, pixels, capacitors and transistors. For a display panel, each pixel-capacitor-transistor-conductor combination in the lattice may fairly be modeled by a resistor and a capacitor to approximate the impedance and parasitic capacitance effects on a row enable signal. To create a delay for the column driver enable signal which approximates the delay experienced by a row enable signal, a plurality of resistive and capacitive elements 66 and 68 are coupled in a delay line as shown in FIG. 5. The blocks CD1, CD2 . . . CD10 represent column driver circuits 70, 72, 74, 78 and 80 for groups of column signal lines in a display panel. The input node IN receives a conventional display timing signal for delaying by the delay circuit before sending it to the column driver circuits 70, 72, 74, 78 and 80.

To determine the values of resistors 66 and capacitors 68 needed in the delay line, the delay/distance curve selected for the particular display panel (see FIG. 4 and related discussion) may be analyzed to determine the resistor-capacitor combinations necessary to produce the desired delays. Numerous well known circuit modeling software packages, such as 'SPICE' distributed by Intusoft of San Pedro, Calif., are available commercially and may be of assistance in charting an appropriate delay/display curve and the required delay and/or resistive and capacitive components. The delay imposed on the column driver enable signal used for each column driver circuit 70–80 should be chosen to approximate the delay needed for the first column signal line among that group of column signal lines. As an example, by reference to the graph of FIG. 4, if there are ten column driver chips CD1–CD10, the delay/distance curve would preferably be divided into 10 equally long sections 48. To approximate the delay of a row enable signal propagating across a display, the delay of the column enable signal needed at the input of a particular column driver circuit is the delay indicated by the graph at the beginning of that driver's group section 48. For the first curve 42 shown in FIG. 4, the fourth column driver is sectioned between marks 52 and 54. The delay needed at the input to the fourth column driver CD4, therefore, is the delay corresponding to mark 52, or approximately 810 ns. The column driver enable signals for the fourth column driver CD4, therefore, are delayed 810 ns before entering the column driver for group 4. A larger or smaller number of groups and divisions may be formed as desired for a particular application.

As specifically illustrated in the fourth column driver block CD4 76 of FIG. 5, in addition to conventional column driver circuitry, an embodiment of the present invention includes delay elements 82 to further delay the column enable signal for each individual column within that column signal line group. By further delaying the column enable signal, a more precise stepwise linear approximation 56 to the curve 42 is formed (see FIG. 4). The necessary delay imposed by each delay element 82 may be determined by dividing the difference between the curve section for that column driver (e.g. 960 ns–810 ns for CD4 between marks 52 and 54 on FIG. 4) by the total number of columns associated with that column driver. In other words, for a particular column driver, each of the delay steps may be made equal for simplicity of driver delay line design.

For different displays, however, there are different characteristics which need to be matched for the display drivers to operate most effectively. This may require individually varying the values of each of the display elements 66 and 68 to find an optimal approximation and, therefore, does not necessarily lend itself to easy adjustments. Furthermore, analog designs are notoriously susceptible to noise and other well known problems associated with analog systems in some applications. While the analog implementations described herein will reduce the effects of row signal propagation delay in display panels, it may be preferable in some cases to use a digital implementation of the invention.

Digital Implementation: As will be clear to one of ordinary skill in the art, the principles behind implementing the delays for display driver enable signals according to the embodiments of the invention in a digital system are similar to those behind implementing the delays in an analog system The same delay/distance curve and calculations may be used for either system, and will, therefore, not be rediscussed here.

Figure 6:
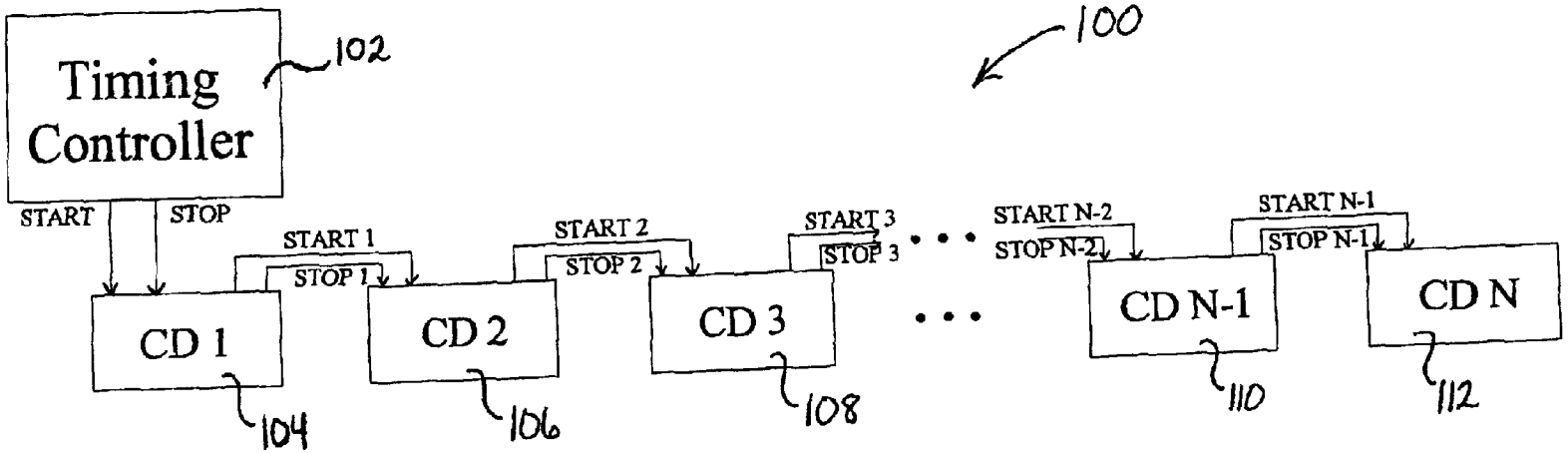
FIG. 6 is a block diagram of a digital implementation of a column driver enable signal delay circuit according to an embodiment of the present invention.

For a digital implementation of the column enable signal delay circuitry according to an embodiment of the invention, reference is made to FIGS. 6–10. FIG. 6 illustrates a general block diagram of the column enable signal delay circuitry 100 which includes a timing controller 102, a plurality of column driver circuits 104, 106, 108, 110 and 112, and START 114 and STOP 116 signal lines coupling each of the column driver circuits 104–112 together in series with the timing controller 102. Alternatively, the timing controller 102 could be directly wired to each of the column driver circuits 104–112. This approach, however, would require additional wiring and space.

Figure 7:
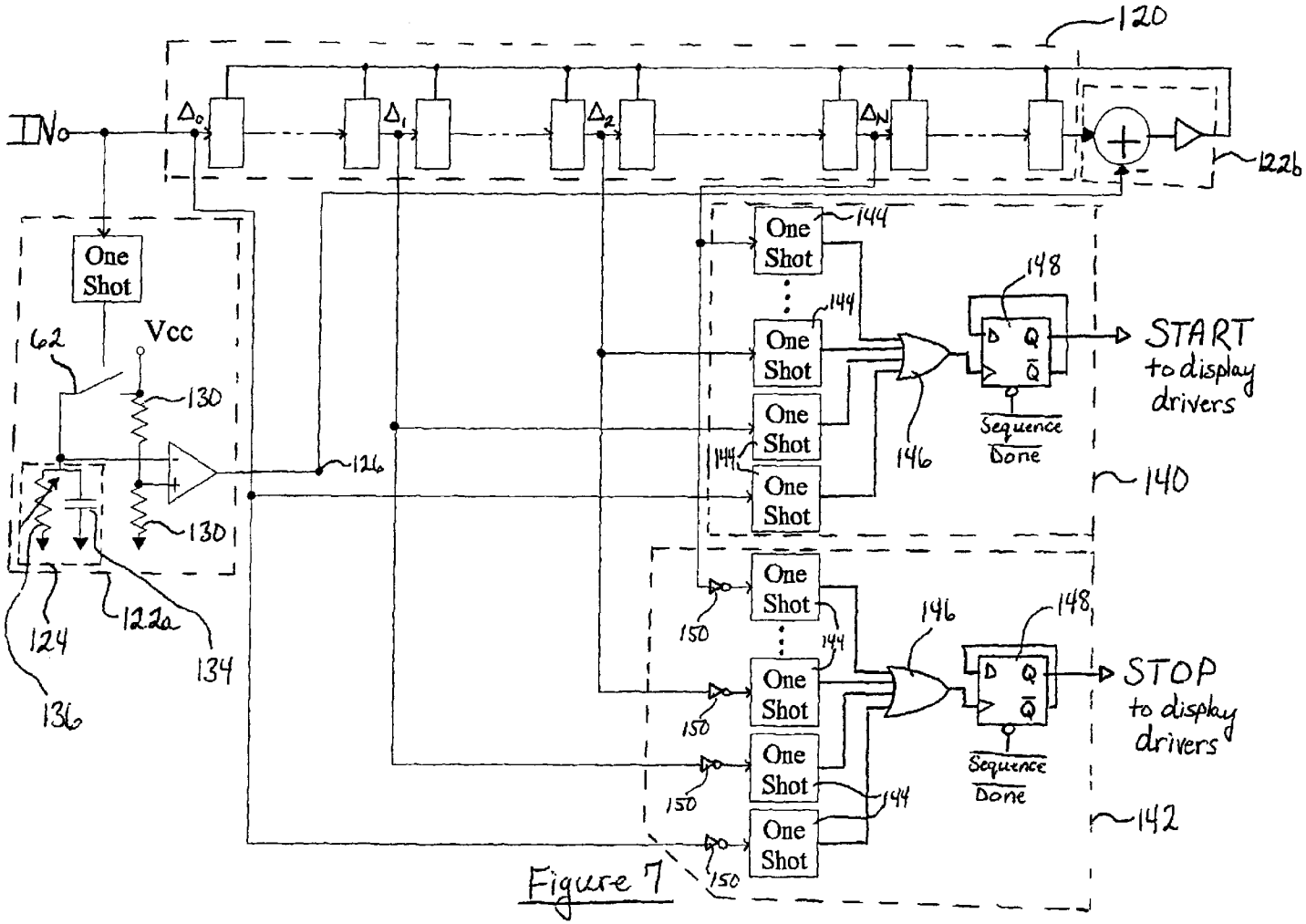
FIG. 7 is a diagram of a portion of a timing controller for a digital implementation of a column driver enable signal delay circuit according to an embodiment of the present invention.

FIG. 7 illustrates one embodiment of a delay portion of the timing controller circuit shown in FIG. 6. Instead of the resistors and capacitors used in the analog embodiment shown in FIG. 5, this digital embodiment uses a delay locked loop 120 to create appropriate delays $\Delta_0, \Delta_1, \Delta_2 \ldots \Delta_{N-1}$ in the column enable signal or other display driver timing signal. By tapping the delay locked loop, at select locations which provide the necessary delay for the column enable signal, appropriately delayed column enable signals may be sent to each of the column driver circuits 104-112. Additionally, a calibration circuit 122*a* and 122*b* may be configured in a feedback loop for making automatic and selective adjustments to the timing of the delays created by the delay locked loop 120.

For automatic adjustments to the timing of the delays, feedback loop circuitry 122*b* is coupled to the individual delay elements of the delay locked loop 120 which uniformly adjusts the delay of every delay element in response to a comparison between the output of the delay locked loop 120 and a reference signal at node 126. When a signal is detected at the input node IN 128 of the delay locked loop 120, a pulse is generated to activate a switch 62, which couples a first reference voltage, such as Vcc, across a variable impedance 124. A comparison between the discharge of the voltage on the variable impedance 124 and a voltage measured between two resistors 130 determines the reference signal at node 126.

For selective adjustments, by increasing the value of the variable resistor 136 in the variable impedance 124, the voltage on the capacitor 134 dissipates slower. By decreasing the value of the variable resistor 136, the voltage on the capacitor 134 dissipates more quickly. If the two resistors 130 are equal, the comparator 132 will be timed to adjust the delay locked loop delays to allow the column enable signal to reach the end of the delay locked loop 120 when the capacitor of the variable impedance 124 is half discharged. Other variable impedance elements may be substituted for the variable resistor 136 and fixed capacitor 134 shown in this embodiment. By using a delay locked loop 120 with a calibration circuit 122, the specific timing of the delay elements is more easily adjusted.

Figure 8:
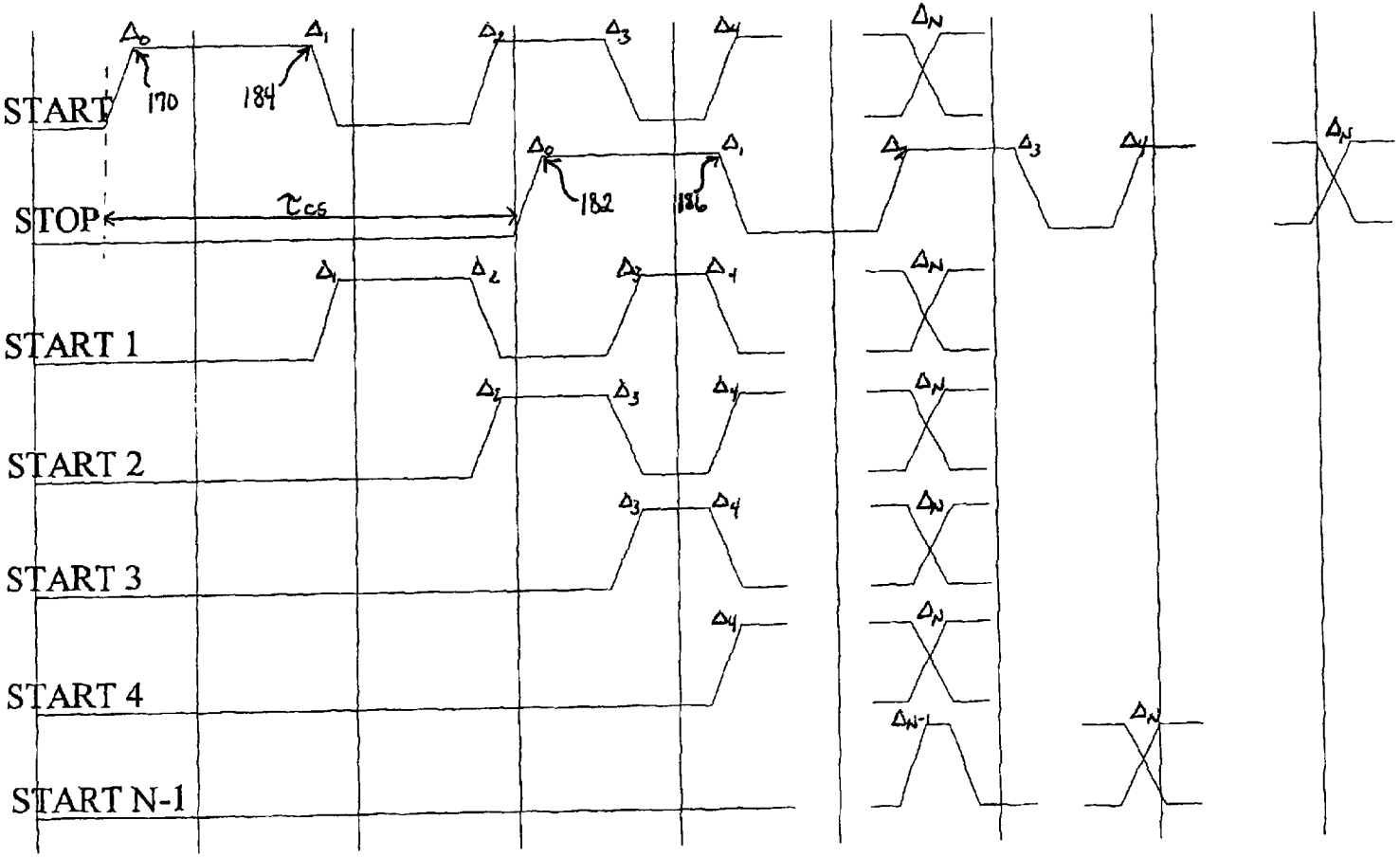
FIG. 8 is a timing diagram of the START and STOP signals generated by the column driver enable signal delay circuit shown in FIG. 7.

The appropriately delayed column enable signals are tapped by to two similar sets of circuitry: one circuitry 140 to generate a START signal, and one circuitry 142 to generate a STOP signal. The STOP signal is the same as the START signal, but delayed in time by the width of the column enable signal ($\tau_{CS}$ on FIG. 8). The width of the column enable signal ($\tau_{CS}$) may also be used to establish the parameters of a "charge share" feature known in the art and described in U.S. Pat. No. 5,852,426, issued Dec. 22, 1998, to Erhart, et al., and assigned to the assignee of the present invention, the disclosure of which is hereby incorporated herein by reference. As can be seen in the circuit of FIG. 7, the circuitry 140 for the START signal includes a pulse generator 144, also called a mono-stable multivibrator or "one-shot", for each tap on the delay locked loop 120. The number of taps corresponds to the number of column driver circuits used. The pulse generators feed into an OR gate 146 which is coupled to a flip-flop circuit 148 clocked by the output of the OR gate 146. The only difference between the circuitry 140 to generate the START signal and the circuitry 142 to generate the STOP signal is that an inverter 150 is placed at the input of each pulse generator 144 for the circuitry 142 to generate the STOP signal. As shown in FIG. 8, the effect of this inverter is to initially clock the flip-flop 148 of the STOP circuitry 142 on the falling edge of the column enable signal rather than the rising edge.

As shown in FIG. 6, the START and STOP signals are conducted to the first column driver 104. The first column driver 104 modifies the START and STOP signals and sends $START_1$ and $STOP_1$ signals to the second column driver 106. This process continues through the remainder of the column drivers. FIG. 8 illustrates how the START, $START_1$, $START_2$ . . . and $START_{N-1}$ signals differ.

Figure 9:
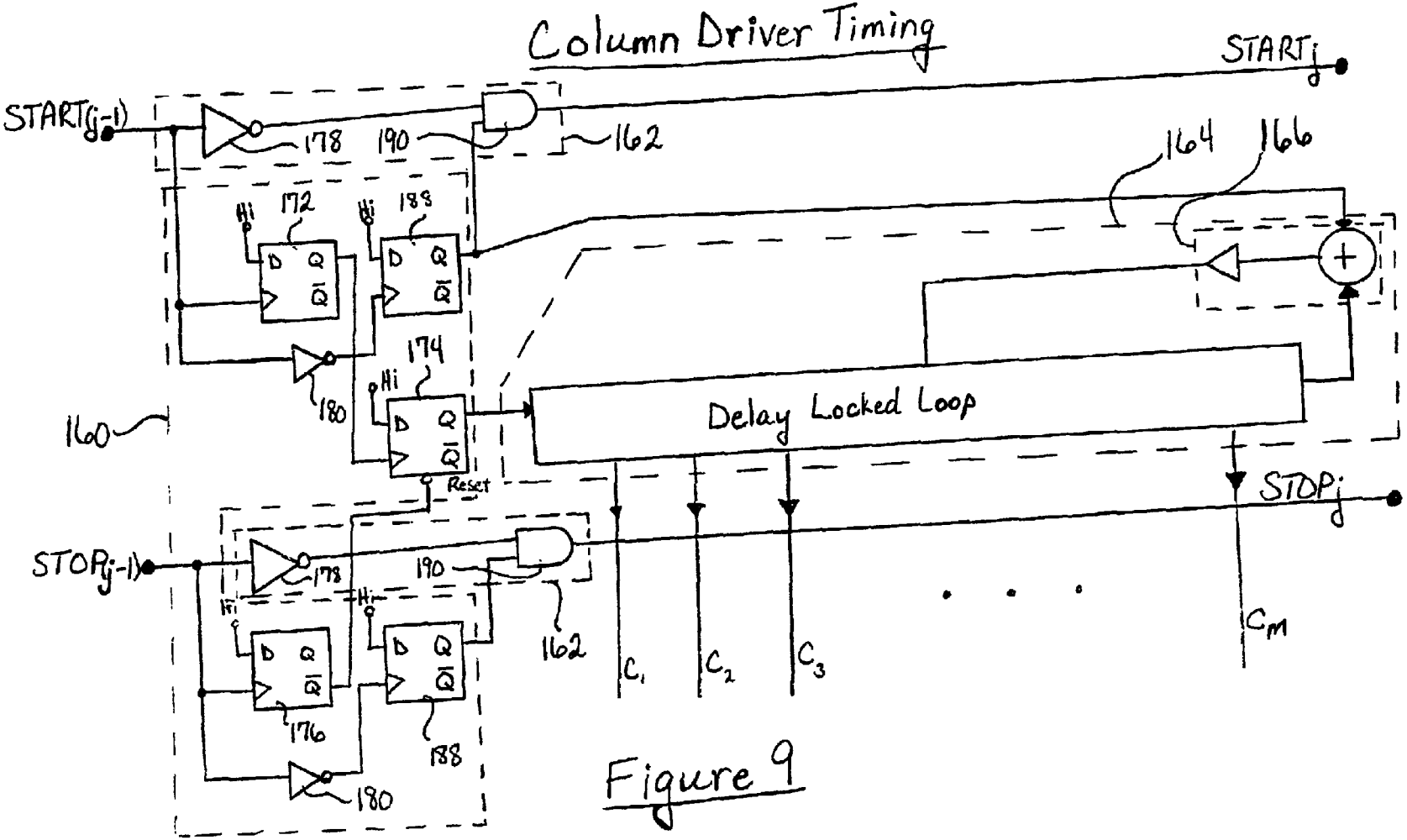
FIG. 9 is a circuit diagram of a digital implementation of a column driver circuit such as those shown in the block diagram of FIG. 6 according to an embodiment of the present invention.

In reference to FIG. 9, in addition to conventional column driver circuitry, each column driver circuit configured according to this embodiment of the present invention includes circuitry 160 to generate a delayed column driver enable signal for the column driver circuit, circuitry 162 to modify the START and STOP signals, and a delay locked loop circuit 164 with automatic calibration circuitry 166. The column driver circuits may be configured substantially identical to each other for simplification, or, in more sophisticated embodiments, the individual delay locked loops 164 within the column driver circuits may be adjusted to better approximate the specific segment of the delay/distance curve charted (see FIG. 4 and related discussion).

When the START signal arrives at the first column driver CD1 104, the first rising edge 170 of the START signal (FIG. 8), clocks the flip-flops 172 and 174 and initiates a column enable signal at the input of the delay locked loop 164. When the first rising edge 182 of the STOP signal (FIG. 8) is received, it clocks flip-flop 176 and resets flip-flop 174 at the input to the delay locked loop 164. The first falling edge 184 and 186 of each of the START and STOP signals (FIG. 8) is passed through respective first 178 and second 180 inverters, clocks a flip-flop 188 and activates an AND gate 190 to produce a rising edge at the output of the column driver stage. The first rising edge 170 and 182 of each of the START and STOP signals passing through a column driver stage is thereby stripped from the respective START and STOP signals and the signals are inverted before passing to the next successive column driver stage. Thus, the first rising edge passed to a column driver circuit corresponds to the timing delay needed for that column driver circuit to approximate the row signal propagation delay ($\Delta_0$, $\Delta_1$, $\Delta_2$ . . . $\Delta_{N-1}$) corresponding to that column driver's location on the display panel.

Figure 10:
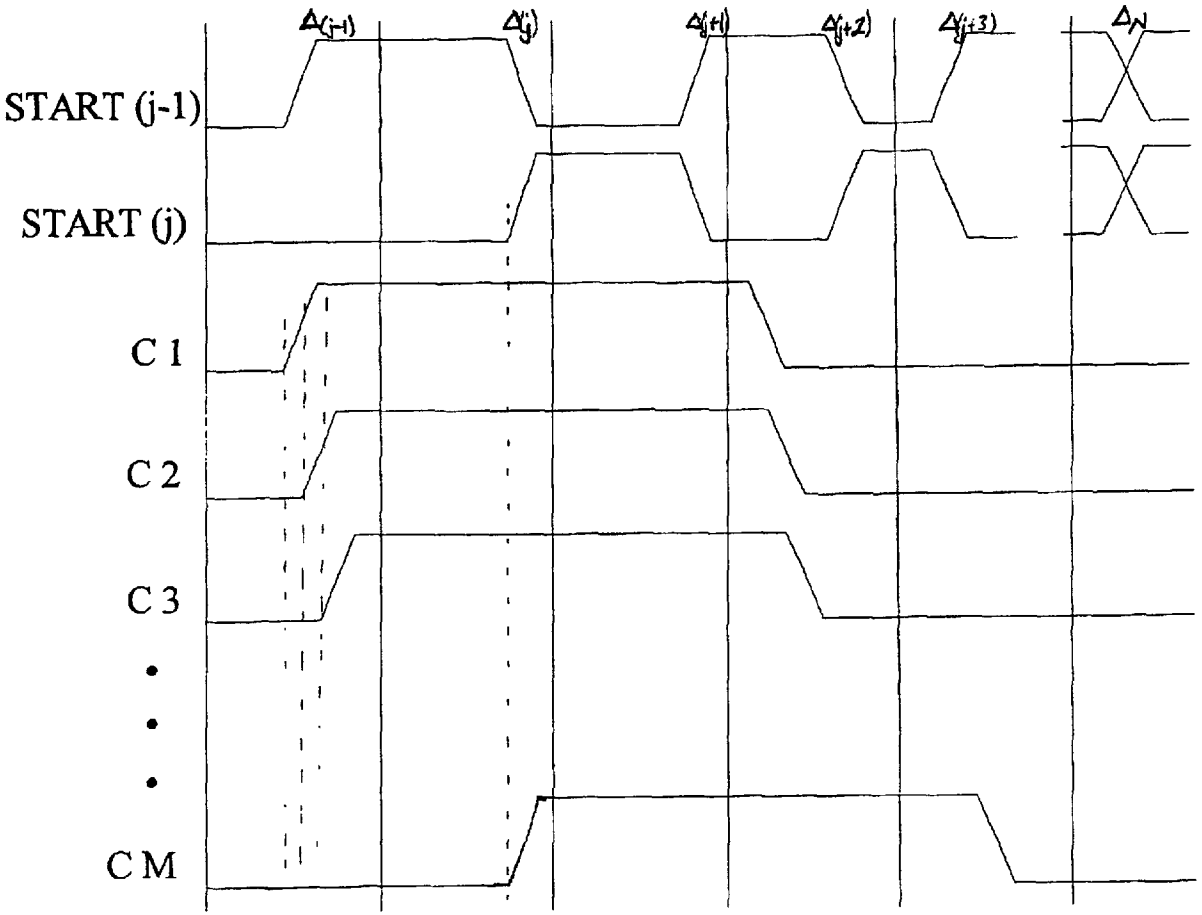
FIG. 10 is a timing diagram of the individual column line enable signals at the output of a column driver enable delay circuit according to an embodiment of the present invention.

Within the delay locked loop 164, a tap or connection for each column signal line $C_1$, $C_2$ . . . $C_M$ is made to the delay locked loop 164. The taps may be evenly spaced throughout the delay locked loop 164, or may be spaced to approximate the delay/distance curve charted (see FIG. 4 and related discussion). If the delay locked loop taps are evenly spaced throughout the delay locked loop 164, the total delay for activation of a particular delayed column enable signal ($\Delta_M{}^T$), as compared to the activation time of the original column enable signal is represented by the following equation:

$$\Delta_{MT} = \Delta_{(j-1)} + \frac{2(M-1)+1}{2} * \frac{\Delta_j - \Delta_{(j-1)}}{M}$$

where j is the sequential number of the column driver, $\Delta_{j-1}$ is the delay for the START signal entering the column driver stage, $\Delta_j$ is the delay for the START signal leaving the column driver stage, and M is the sequential number of the column signal line in the column driver. FIG. 10 shows a timing diagram for the individual column enable signals for the column signal lines within a particular column driver circuit with respect to the START and STOP signals at the input of the particular column driver circuit.

In summary, therefore, the purpose of the first delay locked loop 120 (FIG. 7) is to establish the general delay times $\Delta_0$, $\Delta_1$, $\Delta_2$ . . . $\Delta_{N-1}$ for the column driver circuits 104–112 (FIG. 6) from the delay/distance curve (FIG. 4). The purpose of the second delay locked loop 164 (FIG. 9) is to establish the specific delay times for each of the column signal lines $C_1$, $C_2$ . . . $G_M$ within each column driver circuit 104–112 (FIG. 6).

Column Signal Propagation Delay Compensation

Figure 11:
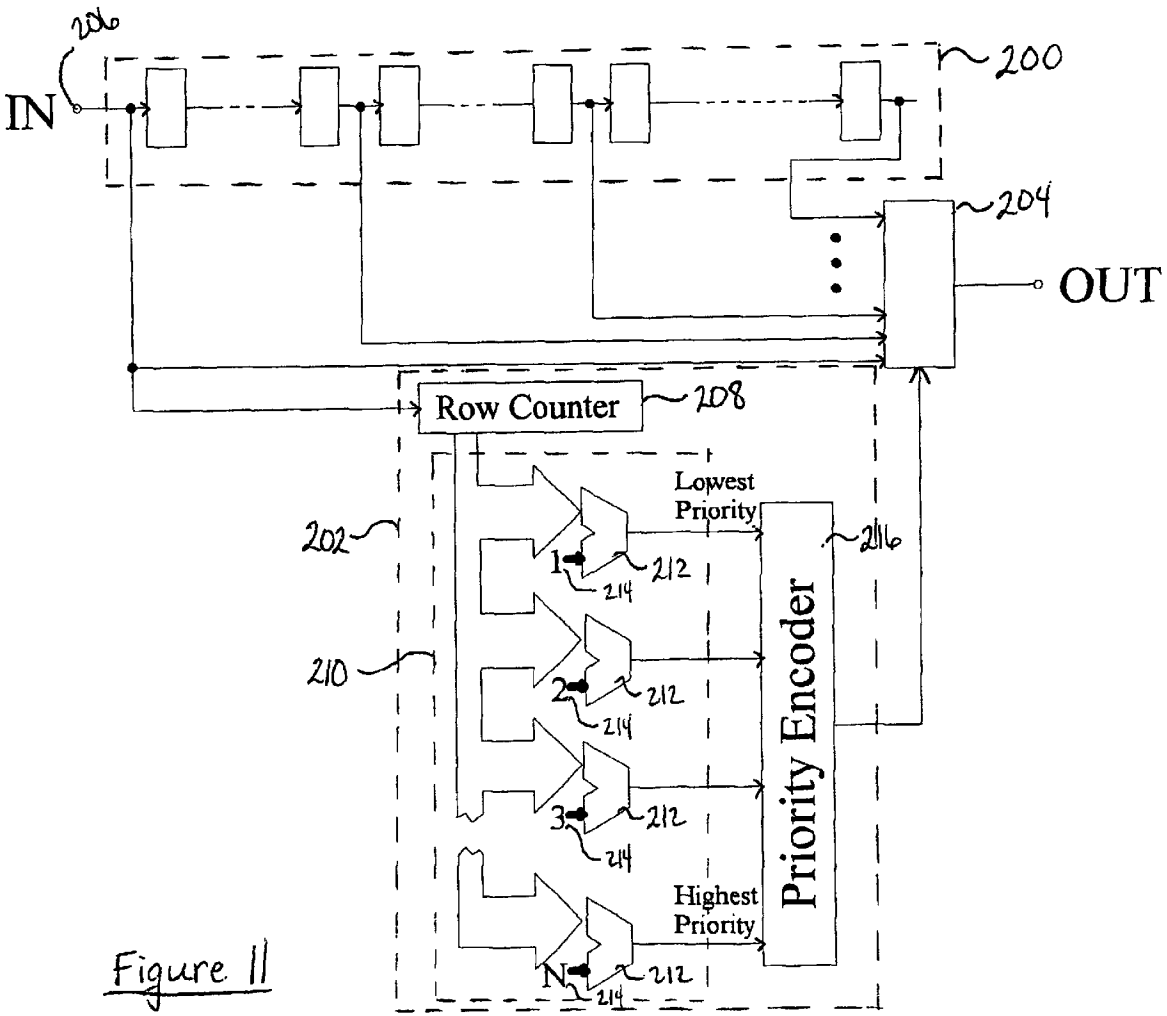
FIG. 11 is a block diagram of a digital implementation of a row driver enable signal delay circuit according to an embodiment of the present invention.

A row driver circuit operates similar to a shift register which steps through a sequence of rows, activating only one row at a time. The approach used to compensate a column signal propagation delay is similar to the previously described for row enable signal propagation delay. The approach involves generating a row timing signal which varies depending on the location on the panel of the present row being activated. As shown in FIG. 11, a delay locked loop 200 is used to generate a plurality of delayed row timing signals for activating row enable signals. Row tracking circuitry 202 is used to evaluate which row or group of rows in the sequence of rows is presently being activated. Finally, delay locked loop tap select circuitry 204 selects which delayed timing signal tap is appropriate for the present row being activated.

Figure 12:
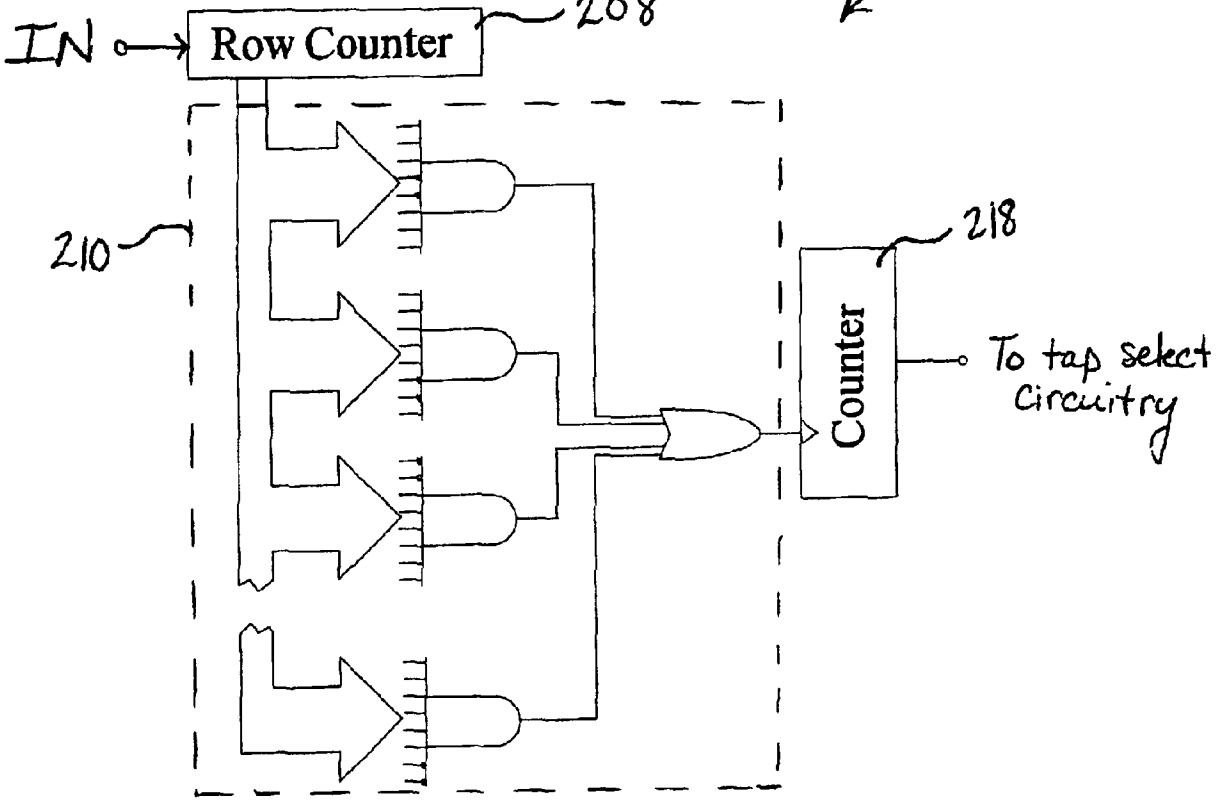
FIG. 12 is a circuit diagram of one embodiment of a row counter circuit according to an embodiment of the present invention.

More specifically, when a row timing signal is received at the input to the timing delay circuit 206, it begins its process through the delay locked loop 200, is tapped by the tap select circuitry 204, such as a multiplexer switch, and clocks the row tracking circuitry 202. A row counter 208, such as a shift register, indicates to comparison circuitry 210 the count of the presently activated row. In the particular embodiment shown, digital comparators 212 within the comparison circuitry 210 compare the row counter indication with fixed count references 214. When the row counter indication exceeds a particular fixed count reference, the output of the digital comparator goes high. Based upon which of the outputs of the digital comparators 212 have most recently gone high, a priority encoder 216 sends an appropriate signal to the multiplexer switch 204 to adjust the delay tap from which the row clock signal is sent out. There are numerous other combinations of components which will operate equivalent to the circuitry described herein without departing from the basic principles and scope of the invention. For example, FIG. 12 illustrates an embodiment of the row tracking circuitry 202 which receives a binary row count from the row counter 208 and uses a plurality of multiple input AND gates, each activated by different binary input combinations, to produce an input to a counter 218 which shifts each time a new group of rows has begun activation.

The specific row clock delay taps for the various groups of row signal lines chosen may be selected by comparison with a delay/distance curve for column signal delay propagation, or may be generally approximated if large delay groups are used. Alternatively, specific circuitry for each row signal line may be implemented, as was done with the column driver circuitry, to more precisely approximate the actual propagation delays experienced by column signals. Similarly, it will be understood by those of ordinary skill in the art that a less precise approximation of the row enable signal propagation delay will result in simpler circuitry for the column driver circuits. Various applications will necessitate varying levels of approximation precision and circuit complications. Furthermore, the circuitry for column signal propagation delay compensation according to embodiments of the present invention may alternatively be implemented in an analog configuration using the principles discussed previously herein.

Although the present invention has been shown and described with reference to particular preferred embodiments, various additions, deletions and modifications that are obvious to a person skilled in the art to which the invention pertains, even if not shown or specifically described herein, are deemed to lie within the scope of the invention as encompassed by the following claims.

What is claimed is:

1. A method of operating an LCD display, the LCD display including pixels arranged in an array of rows and columns, row driver circuitry including a plurality of row drivers, each of the plurality of row drivers being coupled to at least one row of pixels, the row driver circuitry applying a row enable signal to a selected one of the rows to enable the pixels within the selected row, and column driver circuitry including a plurality of column drivers, each of the plurality of column drivers being coupled to at least one column of pixels, for driving voltages onto the columns of the LCD display for storage in the pixels of the selected row, the columns of the LCD display including at least a first column located relatively proximate to the row driver circuitry and at least a second column located relatively distant from the row driver circuitry, the row enable signal being subject to a propagation delay as it is conducted along the selected row as measured between the first column and the second column, the method comprising the steps of:

a. applying the row enable signal to a first selected row of the LCD display via the row driver circuitry at a first predetermined time and for a predetermined duration;

b. enabling a first column driver for applying a first driving voltage onto the first column of the LCD display at a second predetermined time and during said first predetermined duration to transfer the first driving voltage onto a first pixel located at an intersection of the first column with the first selected row;

c. enabling a second column driver for applying a second driving voltage onto the second column of the LCD display at a third predetermined time and during said first predetermined duration to transfer the second driving voltage onto a second pixel located at an intersection of the second column with the first selected row; and d. delaying the third predetermined time beyond the second predetermined time by a delay that is approximately equal to the propagation delay but less than said first predetermined duration.

2. The method of claim 1 wherein each voltage driven onto a selected column of the LCD display is also subject to a column propagation delay as it is conducted along the selected column as measured between the column driver circuitry and a row relatively distant from the column driver circuitry, the method further comprising the steps of:

e. applying a driving voltage onto the selected column of the LCD display at a first predetermined time; and f. enabling a row driver for applying the row enable signal to the row relatively distant from the column driver at a second predetermined time delayed beyond the first predetermined time by a delay that is approximately equal to the column propagation delay.

3. A method of operating an LCD display, the LCD display including pixels arranged in an array of rows and columns, row driver circuitry including a plurality of row drivers, each of the plurality of row drivers being coupled to at least one row of pixels for applying a row enable signal to a selected one of the rows to enable the pixels within the selected row, and column driver circuitry including a plurality of column drivers, each of the plurality of column drivers being coupled to at least one column of pixels for driving voltages onto the columns of the LCD display for storage in the pixels of the selected row, the rows of the LCD display including at least a first row located relatively proximate to the column driver circuitry and at least a second row located relatively distant from the column driver circuitry, each voltage driven onto each columns of the LCD display being subject to a column propagation delay as it is conducted along the column as measured between the column driver circuitry and the second row, the method comprising the steps of:

a. applying driving voltages onto the columns of the LCD display at a first predetermined time; and b. enabling a row driver for applying the row enable signal to the second row at a second predetermined time delayed beyond the first predetermined time by a delay that is approximately equal to the column propagation delay, the row enable signal being applied for a predetermined duration; and c. storing the driving voltages driven onto the columns of the LCD display into each of the pixels of the enabled row during such predetermined duration.

4. A method of compensating for propagation delay of a row display line signal in a display having display elements accessed by an array of row display lines and column display lines, the display including a plurality of row drivers corresponding to the number of rows in the array, and including a plurality of column drivers corresponding to the number of columns in the array, each display element being addressed by applying a row enable signal for a predetermined duration to the row display line in which such display element lies and by applying a column driving signal to the column display line in which such display element lies, a plurality of the display elements in a particular row of the display being addressed during the predetermined duration of the row enable signal, the method comprising the steps of:

a. generating a column display line timing signal during each row enable signal for initiating an activation cycle of column drivers;

b. generating a first plurality of delayed column display line timing signals in response to the column display line timing signal;

c. activating a row display line for said predetermined duration; and d. activating at least one column display line in response to each of the first plurality of delayed column display line timing signals, while activating all of the column display lines during said predetermined duration.

5. The method of claim 4, wherein the step of generating the first plurality of delayed column display line timing signals comprises:

approximating a first propagation delay for the row display line signal to propagate from its source to a pixel associated with a first column display line; and generating one of the first plurality of delayed column display line timing signals to include a delay substantially equal to the approximated first propagation delay for the row display line signal.

6. The method of claim 4, further comprising the steps of:

generating a second plurality of delayed column display line timing signals in response to one or more of the first plurality of delayed column display line timing signals; and activating at least one column display line in response to each of the second plurality of delayed column display line timing signals.

7. The method of claim 4, further comprising the steps of:

tracking which column display line of a plurality of column display lines is next to be activated;

selecting one of the first plurality of delayed column display line timing signals in response to the tracking of which column display line is next to be activated; and activating a column display line in response to the one of the first plurality of delayed column display line timing signals.

8. The method of claim 4, wherein the column display line timing signal comprises signal components to activate a plurality of column display lines at varying times.

9. The method of claim 8, further comprising the step of generating a second plurality of delayed column display line timing signals in response to a first component of the column display line timing signal.

10. The method of claim 9, further comprising the steps of:

removing the first component of the column display line timing signal; and generating a second plurality of delayed column display line timing signals from a second component of the column display line timing signal.

11. The method of claim 9, further comprising activating at least one column display line in response to each of the second plurality of delayed column display line timing signals.

12. A display line driver circuit for a display, the display including display elements arranged in an array of rows and columns and including a plurality of row drivers corresponding to the number of rows in the array, and including a plurality of column drivers corresponding to the number of columns in the array, each display element being addressed by applying a row enable signal for a predetermined duration to the row in which such display element lies and by applying a column driving signal to the column in which such display element lies, a plurality of the display elements in a particular row of the display being addressed during the predetermined duration of the row enable signal, the display line driver circuit generating display line timing signals, and comprising:

a. a first plurality of delay elements operatively coupled together such that a signal propagating through the first plurality of delay elements is increasingly delayed as it propagates through each successive delay element;

b. a plurality of signal taps, each coupled between a selected pair of delay elements; and c. at least one display line associated with each signal tap.

13. The display line driver circuit of claim 12 wherein each of the first plurality of delay elements comprises at least one of a resistive and a capacitive element.

14. The display line driver circuit of claim 12 wherein the first plurality of delay elements comprises a delay locked loop circuit.

15. The display line driver circuit of claim 12 further including a plurality of column line driver group circuits each coupled to at least one of said signal taps and wherein each column line driver group circuit has a plurality of column signal lines associated therewith.

16. The display line driver circuit of claim 15 further comprising a pulse generator coupled to each signal tap.

17. The display line driver circuit of claim 16 wherein each pulse generator is coupled to its respective signal tap through an inverter.

18. The display line driver circuit of claim 14 further comprising a delay locked loop adjustment circuit.

19. A display line driver circuit for a display including display elements arranged in an array of rows and columns, the display line driver circuit generating display line timing signals, and comprising:

a. a first plurality of delay elements operatively coupled together such that a signal propagating through the first plurality of delay elements is increasingly delayed as it propagates through each successive delay element, the first plurality of delay elements including a delay locked loop circuit;

b. a plurality of signal taps, each coupled between a selected pair of delay elements;

c. at least one display line associated with each signal tap;

d. a delay locked loop adjustment circuit;

e. the delay locked loop circuit an input and an output; and f. the delay locked loop adjustment circuit comprises:

i) a calibration pulse generator coupled to the input of the delay locked loop circuit;

ii) a first comparator having an inverting input, a non-inverting input, and an output, the non-inverting input being coupled to the output of the delay locked loop circuit;

iii) a second comparator having an inverting input, a non-inverting input, and an output, the output of the second comparator being coupled to the inverting input of the first comparator;

iv) a variable impedance element coupled between the inverting input of the second comparator and a first reference voltage;

v) a first impedance element coupled between a second reference voltage and the non-inverting input of the second comparator; and vi) a second fixed impedance coupled between the non-inverting input of the second comparator and the first reference voltage.

20. The display line driver circuit of claim 18 wherein the delay locked loop adjustment circuit comprises a variable resistor coupled in parallel with a capacitor.

21. The display line driver circuit of claim 20 wherein the delay locked loop adjustment circuit includes a variable resistance, the delay locked loop adjustment circuit being configured to increase a relative delay of the delay elements as the variable resistance is increased, and to decrease the relative delay of the delay elements as the variable resistance is decreased.

22. The display line driver circuit of claim 15, wherein each column line driver group circuit comprises:

a. a second plurality of successive delay elements operatively coupled together such that a signal propagating through the second plurality of delay elements is increasingly delayed as it propagates through each successive delay element;

b. a plurality of signal taps each coupled between a selected pair of successive delay elements within the second plurality of successive delay elements; and c. at least one column signal line associated with each signal tap.

23. The display line driver circuit of claim 12 wherein the display line driver circuit is a row driver circuit, and wherein the at least one display line associated with each signal tap includes a plurality of row line groups, each of the plurality of row line groups being associated with a signal tap, and each of the plurality of row line groups having a plurality of row lines associated therewith.

24. The display driver of claim 23, wherein the row driver circuit sequentially initiates each row of each plurality of row lines with a signal having a delay corresponding to the row line group with which it is associated.

25. The display driver of claim 24, further comprising a row counter circuit for tracking the sequential initiation of row lines and for selecting an appropriate signal tap through which a row initiation signal is to be received for each row line.

26. A display having pixels arranged in an array of rows and columns, row driver circuitry including a row driver for each row of the array, the row driver circuitry applying a row enable signal to a selected one of the rows to enable the pixels within the selected row, and column driver circuitry including a column driver for each column of the array for driving voltages onto the columns of the display for storage in the pixels of the selected row, the columns of the display including at least a first column located relatively proximate to the row driver circuitry and at least a second column located relatively distant from the row driver circuitry, the row enable signal being subject to a propagation delay as it is conducted along the selected row as measured between the first column and the second column, the display comprising:

a. a first plurality of delay elements within the column driver circuitry which are operatively coupled together such that a signal propagating through the first plurality of delay elements is increasingly delayed as it propagates through each successive delay element; and b. a signal tap associated with the second column coupled at a selected point between two of the delay elements such that the delay of the signal propagating through the first plurality of delay elements at that selected point is substantially equal to the propagation delay of the row enable signal along the selected row when it reaches the second column.

27. The display of claim 26, wherein the first plurality of delay elements comprises at least one element selected from the group of elements that includes resistive and capacitive elements.

28. The display of claim 26, wherein the first plurality of delay elements comprises a delay locked loop circuit.

29. The display of claim 26 further comprising a group of columns associated with a column group driver circuit for driving voltages onto each column of the group, said group of columns including the second column.

30. The display of claim 29 further comprising a first pulse generator coupled to the signal tap.

31. The display of claim 30 further comprising a second pulse generator coupled to the signal tap through an inverter.

32. The display of claim 29 further comprising a delay locked loop adjustment circuit.

33. A display having pixels arranged in an array of rows and columns, row driver circuitry for applying a row enable signal to a selected one of the rows to enable the pixels within the selected row, and column driver circuitry for driving voltages onto the columns of the display for storage in the pixels of the selected row, the columns of the display including at least a first column located relatively proximate to the row driver circuitry and at least a second column located relatively distant from the row driver circuitry, the row enable signal being subject to a propagation delay as it is conducted along the selected row as measured between the first column and the second column, the display comprising:

i) a first plurality of delay elements within the column driver circuitry which are operatively coupled together such that a signal propagating through the first plurality of delay elements is increasingly delayed as it propagates through each successive delay element;

ii) a signal tap associated with the second column coupled at a selected point between two of the delay elements such that the delay of the signal propagating through the first plurality of delay elements at that selected point is substantially equal to the propagation delay of the row enable signal when it reaches the second column;

iii) a group of columns associated with a column group driver circuit for driving voltages onto each column of the group, said group of columns including the second column; and iv) a delay locked loop adjustment circuit including:

a. a calibration pulse generator coupled to the input of the delay locked loop circuit;

b. a first comparator having an inverting input, a non-inverting input, and an output, the non-inverting input being coupled to the output of the delay locked loop circuit;

c. a second comparator having an inverting input, a non-inverting input, and an output, the output of the second comparator being coupled to the inverting input of the first comparator;

d. a variable impedance element coupled between the inverting input of the second comparator and a first reference voltage;

e. a first impedance element coupled between a second reference voltage and the non-inverting input of the second comparator; and f. a second fixed impedance coupled between the non-inverting input of the second comparator and the first reference voltage.

34. The display of claim 32 wherein the delay locked loop adjustment circuit comprises a variable resistor coupled in parallel with a fixed capacitor.

35. The display of claim 34 wherein the delay locked loop adjustment circuit includes a variable resistance, the delay locked loop adjustment circuit being configured to increase a relative delay of the delay elements as the resistance of the variable resistor is increased, and to decrease the relative delay of the delay elements as the resistance of the variable resistor is decreased.

36. The display of claim 29, wherein the column driver group circuit comprises:

a. a second plurality of successive delay elements operatively coupled together such that a signal propagating through the second plurality of delay elements is increasingly delayed as it propagates through each successive delay element;

b. a signal tap associated with a third column among the column group and coupled at a selected point between two of the successive delay elements within the second plurality of successive delay elements; such that the delay of the signal propagating through the second plurality of successive delay elements at that selected point is substantially equal to the propagation delay of the row enable signal along the selected row when it reaches the third column.

37. The display of claim 26 wherein the row driver circuitry is configured to sequentially apply a row enable signal to each row associated with the row driver circuitry at predetermined intervals, the row driver circuitry having associated therewith at least a first row located relatively proximate to the column driver circuitry and at least a second row located relatively distant from the column driver circuitry, each voltage driven onto a column being subject to a propagation delay as it is conducted along the selected column as measured between the first row and the second row, the display further comprising:

a. a plurality of successive row signal delay elements within the row driver circuitry which are operatively coupled together such that a signal propagating through the plurality of successive row signal delay elements is increasingly delayed as it propagates through each successive row delay element;

b. a plurality of signal taps associated with selected points among the plurality of successive row signal delay elements; and c. circuitry configured to select a first signal tap from among the plurality of signal taps which will approximate the propagation delay of the voltage driven onto a column as it reaches the second row.

38. A display signal timing controller for a display having a plurality of display elements arranged in an array of rows and columns, row driver circuitry for applying a row enable signal to a selected one of the rows in response to a row timing signal, the row enable signal being subject to a propagation delay as it is conducted along the row, and column driver circuitry for driving voltages onto the columns of the display for storage in the pixels of the selected row in response to a column timing signal, the voltage driven onto the column also being subject to a propagation delay as it is conducted along the column, the display signal timing controller comprising:

a. a delay locked loop circuit including a plurality of delay elements coupled in series for delaying a first display timing signal;

b. a plurality of taps coupled between select delay elements of the delay locked loop circuit for tapping delayed portions of the first display timing signal; and c. output circuitry configured to generate a second display timing signal in response to the first display timing signal, the output circuitry being coupled to said plurality of taps and being responsive to the tapped delayed portions of the first display timing signal, the second display timing signal changing state to a first condition in response to the receipt of the first display timing signal and maintaining the second display timing signal in the first condition at least until all of the tapped delayed portions of the first display timing signal have been received.

39. The display signal timing controller of claim 38 further comprising a plurality of display driver circuits, wherein each of the display driver circuits comprises:

a. input circuitry configured to generate a third display timing signal in response to the second display timing signal;

b. a second plurality of delay elements for delaying the third display timing signal; and c. a plurality of taps coupled between select delay elements of the second plurality of delay elements for tapping delayed portions of the third display timing signal.

40. A display having pixels arranged in an array of rows and columns, row driver circuitry including a plurality of row drivers, each of the plurality of row drivers being coupled to at least one row of pixels, the row driver circuitry applying a row enable signal to a selected one of the rows to enable the pixels within the selected row, and column driver circuitry including a plurality of column drivers, each of the plurality of column drivers being coupled to at least one column of pixels for driving voltages onto the columns of the display for storage in the pixels of the selected row, the rows of the display including at least a first row located relatively proximate to the column driver circuitry and at least a second row located relatively distant from the column driver circuitry, each of the voltages driven onto the columns being subject to a propagation delay as such voltages are conducted along the columns as measured between the first row and the second row, the display comprising:

a. a plurality of successive row signal delay elements within the row driver circuitry which are operatively coupled together such that a signal propagating through the plurality of successive row signal delay elements is increasingly delayed as it propagates through each successive row signal delay element;

b. a plurality of signal taps associated with selected points among the plurality of successive row signal delay elements; and c. circuitry configured to select a first signal tap from among the plurality of signal taps which will approximate the propagation delay of the voltages driven onto the columns as such voltages reach the second row.

* * * * *